US007340998B2

(12) United States Patent
Kyytsönen

(10) Patent No.: US 7,340,998 B2
(45) Date of Patent: Mar. 11, 2008

(54) ARRANGEMENT FOR CLOSING ROLL NIPS

(75) Inventor: Markku Kyytsönen, Numminen (FI)

(73) Assignee: Metso Paper, Inc., Helsinki (FI)

( * ) Notice: Subject to any disclaimer, the term of this patent is extended or adjusted under 35 U.S.C. 154(b) by 48 days.

(21) Appl. No.: 10/516,572

(22) PCT Filed: Jun. 5, 2003

(86) PCT No.: PCT/FI03/00445

§ 371 (c)(1),
(2), (4) Date: Feb. 4, 2005

(87) PCT Pub. No.: WO03/104553

PCT Pub. Date: Dec. 18, 2003

(65) Prior Publication Data

US 2005/0139094 A1 Jun. 30, 2005

(30) Foreign Application Priority Data

Jun. 6, 2002 (FI) ..... 20021084

(51) Int. Cl.
*B30B 3/04* (2006.01)

(52) U.S. Cl. ..... 100/161; 100/164; 100/169

(58) Field of Classification Search ..... 100/155 R, 100/161–170, 331; 162/202, 203, 205, 358.3; 492/50

See application file for complete search history.

(56) References Cited

U.S. PATENT DOCUMENTS

| | | | |
|---|---|---|---|
| 4,389,933 | A | 6/1983 | Pav |
| 4,736,678 | A | 4/1988 | Stotz |
| 6,129,011 | A | 10/2000 | Cramer |
| 6,305,280 | B1 | 10/2001 | Beckers |
| 2003/0101880 | A1 * | 6/2003 | Koivukunnas et al. ..... 100/161 |

FOREIGN PATENT DOCUMENTS

EP 0 735 185 B1 7/2001

(Continued)

OTHER PUBLICATIONS

Written Opinion issued in PCT/FI03/00445.

(Continued)

*Primary Examiner*—Jimmy T. Nguyen
(74) *Attorney, Agent, or Firm*—Stiennon & Stiennon

(57) ABSTRACT

A multi-roll calender (1) has one or several sets of rolls (2) attached to a frame (7) so that each set of rolls has at least three rolls. At least the first roll (3; 31) and the last roll (3; 32) have casings which can be moved toward the intermediate rolls (4). The first roll (3; 31) and the last roll (3; 32) are fixedly attached, at least one of the intermediate rolls (4) in the set of rolls is fixedly attached, and the other intermediate rolls are provided with lightening elements for lightening the auxiliary means related to the intermediate rolls. The roll nips (N) in the set of rolls (2) are closed by moving the first roll towards the intermediate rolls (4), and the roll nips between the last roll and the fixed intermediate roll included, are closed by moving the last roll towards the intermediate rolls (4).

14 Claims, 2 Drawing Sheets

FOREIGN PATENT DOCUMENTS

| | | | |
|---|---|---|---|
| FI | 83346 | | 3/1991 |
| FI | 113071 | B | 2/2004 |
| WO | WO 01/16424 | A1 | 3/2001 |
| WO | WO 03/104553 | A1 | 12/2003 |

OTHER PUBLICATIONS

International Preliminary Examination Report Issued in PCT/FI03/00445.
International Search Report issued in PCT/FI03/00445.
Search Report issued in FI 20021084.

* cited by examiner

ARRANGEMENT FOR CLOSING ROLL NIPS

CROSS REFERENCES TO RELATED APPLICATIONS

This application is a U.S. national stage application of International Application No. PCT/FI03/00445, filed Jun. 5, 2003, the disclosure of which is incorporated by reference, and claims priority on Finnish Application No. 20021084, Filed Jun. 6, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to an arrangement for closing roll nips in a multi-nip calender.

In a multi-roll calender (in the following also multi-nip calender) there often are as many as 10-12 rolls, which are located in the same or a different set of rolls in the same or a different frame so that one set of rolls always has 3-12 rolls. Each set of rolls has a first roll and a last roll, and one or more intermediate rolls between these rolls. In a set of rolls, a roll nip is always left between two adjacent rolls, in which roll nip the surface of the fibre web is profiled in a desired way. In a multi-roll calender, the roll nip is generally formed between a roll with an elastic surface, such as a polymer-coated roll, and a heated, smooth-surfaced steel roll or cast iron roll. For calendering both sides of the fibre web in the same way, the multi-roll calender often has a so-called reverse nip, which is a roll nip formed between two similar rolls, such as, for example, between two polymer-coated rolls. The one-sidedness of the fibre web can also be controlled so that, instead of the reverse nip, the calender is divided into two different sets of rolls. In a usual supercalender, in which the plane of the set of rolls is located substantially vertically in relation to the floor plane, the uppermost and the lowermost roll are variable crown rolls with chilled surfaces, in other words rolls, in which the deflection caused by their own weight has been compensated by internal loading elements of the roll. The intermediate rolls are alternately rolls with chilled surface, heated by water, and paper-or polymer-coated rolls; nowadays, most often polymer-coated rolls. The linear pressure in roll nips grows when transferring from the upper nip to the lower nip, due to earth gravity, and the linear loads of the roll nips depend on the specific weight of the rolls. The linear loads transverse to the machine direction of the roll nips, i.e. the linear loading profile also often has deflections, due to the load forces influencing the axle journals at the ends of the intermediate rolls, caused by auxiliary means, such as bearing houses and steam boxes.

In the so-called Optiload multi-roll calendering (multi-nip calendering) developed by Metso Paper, Inc., the own weight of the intermediate rolls has been lightened so that the axle journals are attached to loading arms: each intermediate roll is attached to loading arms from the bearing houses, the loading arms being again attached to the calender frame. With the loading arms it is possible to direct roll-lifting forces of different sizes to the ends of the roll and thus to compensate to a desired extent the influence caused by the own weight of the roll and the auxiliary means, loading the roll nips and thus increasing the linear loads of the roll nips. In this calendering method, also the deflections caused by the auxiliary means at the ends of the rolls have been compensated in the linear loading profiles transverse to the machine direction of the roll nips. The intermediate rolls have further been selected so that they have almost the same specific deflection caused by earth gravity. In this kind of calendering method, it is possible to use substantially the same linear pressure in all roll nips, i.e. the linear load distribution of the roll nips is uniform. Of the present calendering methods, this calendering method has the largest calendering window, i.e. with this method, it is possible to calender almost all paper qualities with high speeds while keeping the profiling quality of the paper good.

In the so-called Optiload method disclosed above, the lowermost roll is arranged to move on guide tracks in the calender frame, and the calendering is initiated by closing the roll nips above the lower roll by lifting the lowermost roll upwards in the plane of the intermediate rolls using hydraulic cylinders attached to the bearing houses. The additional load to the roll nips is brought either from above or below, for example, by loading the uppermost or lowermost roll with the additional load.

SUMMARY OF THE INVENTION

The principal object of the invention is to eliminate the drawbacks in the state-of-the-art technology. Thus, the object of the invention is to provide a method for closing the roll nips in a set of rolls, in which it is possible to replace the heavy hydraulic cylinders connected to the lower roll with a lighter arrangement. It is also the object of the invention to provide a method, in which the control of the linear loads of the roll nips and the control of the roll loads in a set of rolls stays good, irrespective of the changed closing method of the roll nips.

In the arrangement of the invention, the multi-roll calender (multi-nip calender) has one set or several sets of rolls attached to one frame or several frames. Each set of rolls has at least three rolls, and at least the first roll and the last roll in the set of rolls is provided with equipment, with which their casing can be transferred in the direction of the plane of the set of rolls towards the intermediate rolls in the set of rolls. In the arrangement, the first roll and the last roll in the set of rolls are fixedly attached, and further, at least one of the intermediate rolls in the set of rolls is fixedly attached. The other intermediate rolls are preferably provided with equipment for lightening the own weight of the intermediate rolls and/or the auxiliary means related to the intermediate rolls. In this case, the roll nips in the set of rolls are closed so that the roll nips of the rolls between the first roll and the fixedly attached intermediate roll are closed by moving the first roll in the set of rolls in the direction of the plane parallel to the set of rolls towards the intermediate rolls, and the roll nips between the last roll and the fixedly attached intermediate roll are closed by moving the last roll in the set of rolls in the direction of the plane parallel to the set of rolls towards the intermediate rolls.

In this application, the direction of the plane of the set of rolls refers to the direction of the plane drawn through the centre line of the rolls in the set of rolls.

In the arrangement disclosed above, there is no need for heavy hydraulic cylinders for lifting the last roll in the set of rolls, i.e. often the lowermost roll as the roll nips are closed, because the first roll and the last roll (or upper roll and lower roll, if the set of rolls is in a vertical position in relation to the floor plane) are fixedly attached to the frame or some other fixed structural element, and the roll nips are closed by moving the casing of the first roll and the last roll towards the intermediate rolls.

In an advantageous embodiment of the invention, the linear load distribution of the roll nips in the set of rolls is adjusted by bringing an additional load to the first and/or last roll in the set of rolls, which generates the linear load to the roll nips in the set of rolls. As distinct from the conventional multi-roll calendars, the additional load does not influence the linear load distribution of the roll nips in a uniform or linear way, but the extent of the load in a certain roll nip depends on whether the roll nip in question is located before the fixedly attached intermediate roll or after the intermediate roll as the set of rolls is looked at from the direction of the influencing force. Thus, the additional load of the first roll has a substantially smaller effect on the linear loads of the intermediate rolls between the fixedly attached intermediate roll and the last roll than on the linear loads of the roll nips of the intermediate rolls between the attached intermediate roll and the first roll. The additional load of the last roll again has a substantially smaller effect on the linear loads of the roll nips between the fixedly attached intermediate roll and the first roll than on the linear loads of the roll nips between the fixedly attached intermediate roll and the last roll.

Thus, a considerable difference is achieved by the fixedly attached intermediate roll to the linear load distributions of the roll nips located on different sides of the intermediate roll in question. In this case, the fixedly attached intermediate roll provides the considerable advantage that there are more means than usual to adjust the linear load distribution of the roll nips and that more possibilities are obtained to adjust the calendering potential of the calender, with which it is possible to adjust, among others, the profiling result of both sides of the fibre web in a more exact manner than before.

The invention is next described in more detail by referring to drawings.

DESCRIPTION OF THE PREFERRED EMBODIMENTS

Figure 1:
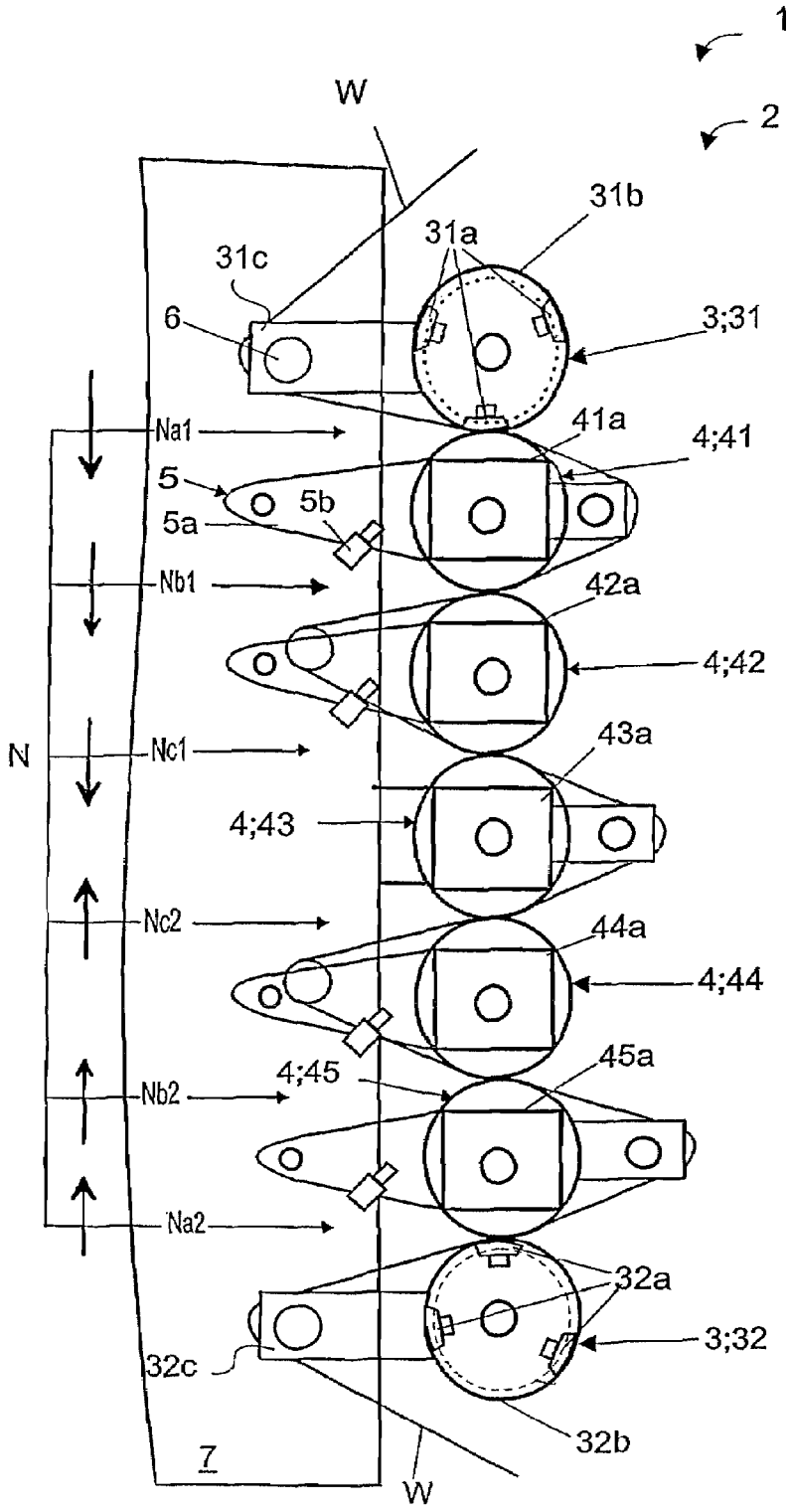
FIG. 1 is a schematic view of a multi-roll calender seen directly towards the end of the set of rolls as the roll nips are being closed.

The main structures of the Figures and which part of the invention the Figures are meant to illustrate, are first gone through. FIG. 1 illustrates the vertical multi-roll calender 1 (=multi-nip calender) arranged to the same calender frame, with five intermediate rolls 4. Of the intermediate rolls, the middlemost one is attached to the calender frame 7, and the other intermediate rolls are provided with lightening equipment for compensating their own gravity. The uppermost and lowermost roll 3 of the calender are attached to the calender frame. In the situation according to FIG. 1, the calendering of the fibre web W is initiated, and the roll nips N are closed.

Figure 2:
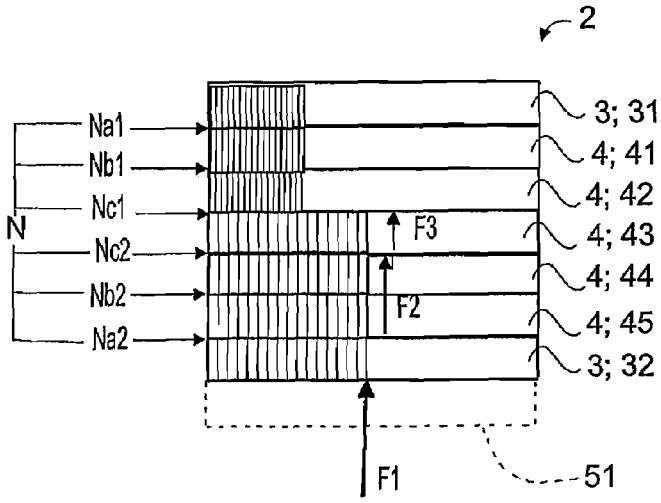
FIG. 2 is a schematic view of the development of the linear load distribution of the set of rolls in FIG. 1 in roll nips located on different sides of the fixedly attached intermediate roll, seen from the front.

FIG. 2 illustrates the development of the linear load distribution of the roll nips N on different sides of the attached intermediate roll in a multi-roll calender of the invention, the set of rolls 2 of which is similar to the one shown in FIG. 1. The set of rolls 2 is shown as a simplified diagram for illustrating the loads. The Figure illustrates the linear pressure generated by the additional load in the roll nips N; Nb1, Nb2 on different sides of the intermediate roll 4; 43, and the development of the linear load distribution in the roll nips N of the set of rolls.

Figure 3A:
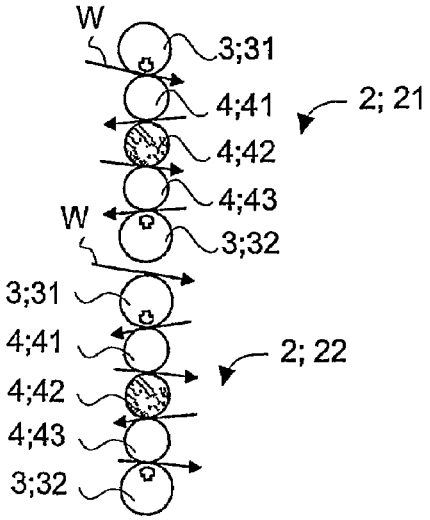
FIG. 3A is a schematic view of a multi-roll calender with two sets of rolls in the same frame, seen directly towards the end.

FIG. 3A illustrates an advantageous embodiment of the invention, in which the multi-roll calender has two sets of rolls 2. Both parts of the set of rolls are attached to the same calender frame. Both parts of the set of rolls have the first roll and the last roll 3 (the upper and lower roll), which are fixedly attached to the frame, and there are three intermediate rolls 4 between them. Of the intermediate rolls, the two outermost ones 4; 41, 43 are attached to the loading arms and the middlemost one is fixedly attached to the calender frame. The calender frame and the attachment of the rolls to the frame and the loading arms are left out of FIG. 3A for simplifying the Figure. These structures are similar to the ones in FIG. 1.

Figure 3B:
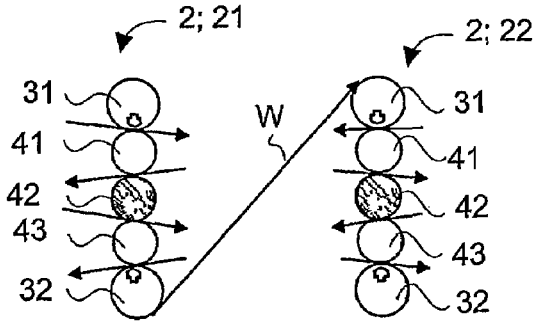
FIG. 3B is a schematic view of a multi-roll calender with two sets of rolls in two different frames, seen directly towards the end.

FIG. 3B illustrates a second advantageous embodiment of the invention, in which the set of rolls has two parts of the set of rolls. Both parts of the set of rolls are similar to the ones in FIG. 3A, but they are attached to different frames. FIG. 3B has been simplified in a similar manner as FIG. 3A.

The multi-roll calender 1 according to FIG. 1 has the upper roll 3; 31 and the lower roll 3; 32, and five intermediate rolls 4; 41, 42, 43, 44, 45. The upper and lower rolls are shown as a partial cross-sectional figure for illustrating the load equipment 31*a* and 32*a* inside them. In addition, the calender 1 includes take-off rolls 6, with which the fibre web arriving from the previous roll is detached from the roll surface before the fibre web is fed to the next roll nip. The uppermost roll and the lowermost roll are so-called Sym rolls, which have the loading devices 3; 31, 32; 31*a*, 32*a* inside the rolls. With the loading devices 31*a*, 32*a* it is possible to compensate deviations caused by the own weight of the upper and lower roll 3, but with the help of these it is also possible to close the roll nips N of the calender and to generate the desired load to the said roll nips. The loading devices 31*a*, 32*a* consist of three shoe element lines, each of which is attached to the fixed axle frame (not shown in the Figure). Each shoe element line has several separate shoe elements, which can be loaded through hydraulic liquid channels leading to them (not shown in the Figures). On top of the shoe elements there is a flexible, polymer-coated roll casing 31*b*, 32*b*, which can be rotated on top of the shoe elements. The structure of such a so-called shoe roll is conventional in itself, and it has been disclosed, for example, in the own patent application of Metso Paper, Inc., so its structure is not described in more detail in this connection.

The uppermost roll 3; 31 and the lowermost roll 3; 32 (or the first and last roll) are attached directly to the calender frame 7 by suitable fastening elements 31*c*, 32*c*.

Between the uppermost and the lowermost rolls there are five intermediate rolls 4, of which the middlemost intermediate roll 4; 43 is likewise attached directly to the calender frame 7 in a similar way as the uppermost and the lowermost rolls. The outermost intermediate rolls, i.e. the first intermediate roll 4; 41 and the fifth intermediate roll 4; 45, seen from the first, i.e. the uppermost roll 3; 31 of the set of rolls, are heated chill rolls. The outermost intermediate rolls 4; 41, 45 are hard-surfaced rolls, which are rotatably pivoted to the bearing houses 41*a*, 45*a* from their ends. The intermediate rolls between the outermost intermediate rolls 41, 45 and the fixedly attached intermediate roll 43, i.e. the second intermediate roll 4; 42 and the fourth intermediate roll 4; 44 are flexible-surfaced polymer-coated rolls. The middlemost intermediate roll is fixedly attached to the calender frame in a similar way as the uppermost and the lowermost roll. The middlemost intermediate roll is a smooth-surfaced metal roll.

The intermediate rolls 41, 42, 44 and 45 are provided with loading arms 5*a* used as lightening elements 5 (shown more exactly only at the place of the intermediate roll 4; 41, because the load lightening elements of the said intermediate rolls are identical), which are attached to the bearing houses 41*a*-45*a* of the said intermediate rolls. The loading arms 5*a* are pivotably joined to the calender frame 7 by axially directed joints. The loading arms 5*a* are provided with lightening elements, such as piston-cylinder elements 5*b*. The lightening elements 5 are used for compensating the deflections caused by the own weight of the rolls in question in the linear loading profiles transverse to the machine direction of the roll nips. The structure of the loading arms 5*a* is conventional in itself and, for example, Metso Paper, Inc.'s patent FI 96334 is referred to with regard to their more detailed structure. The diameters and weights of the intermediate rolls 4 have been chosen so that their natural specific deflection is substantially the same.

In FIG. 1, the calendering of the fibre web W is initiated, and the roll nips N are closed. The roll nips N are closed by loading the internal loading devices 31*a*, 32*a* of the upper and lower roll 3; 31, 32. The loading devices 31*a*, 32*a* are loaded by directing hydraulic liquid to the shoe elements so that the hydraulic liquid forms a lubricating liquid layer between the shoe elements and the casings of the upper and lower rolls rotating on them. Upon extending, the casing 32*b* of the lower roll pushes close the roll nips N; Na2, Nb2 and Nc2 above it. Respectively, the casing 31*b* of the upper roll pushes close the roll nips N; Na1, Nb1 and Nc2 below it, as it extends. By loading the shoe elements of the upper and lower roll with a desired force, a linear pressure of about 0-500 kN can be generated to the roll nips N.

FIG. 2 presents the development of the linear load distribution of the roll nips N in the set of rolls 2 as loads are directed to the intermediate rolls 4 on the lower roll 3; 32. For facilitating the observation it is assumed that the own gravity of the intermediate rolls and the load caused by the auxiliary means related to the intermediate rolls 4; 4; 41, 42, 43 and 44 is completely lightened. The set of rolls 2 is similar to the one shown in FIG. 1 so that the intermediate roll 43 is fixedly attached to the calender frame. In FIG. 2 it is shown how the additional load F1 brought to the lowermost roll causes the linear load F2 in the roll nip N; Nc2 facing the lowermost roll of the fixedly attached intermediate roll, and the additional load F3 in the roll nip N; Nc1 on the other side of the intermediate roll. The additional load F1 and the loads F2 and F3 are marked approximately to the middle point of the lower roll and the roll nips as resultant forces; in fact, the load forces in question are distributed to the length of the whole lower roll and the roll nips Nc1 and Nc2. The linear load F2 achieved by the additional load F1 in the roll nip Nc2 between the fixed intermediate roll 32 and the intermediate roll 44 is considerably bigger than the linear load F3 in the roll nip Nc1 between the fixed intermediate roll 43 and the intermediate roll 42, due to the rigid fastening of the intermediate roll 4; 43. The additional load F1 could as well be brought to the upper roll 31, in which case the additional load would cause a linear load in the roll nip Nc1 between the fixedly attached intermediate roll 43 and the intermediate roll 42, respectively, which would be considerably bigger than the linear load in the roll nip Nc2 between the fixed intermediate roll 43 and the intermediate roll 44. The additional load can be brought to the lower/upper roll either by internal loading devices of the said upper and lower rolls 3; 31, 32, with which the deflections usually caused by the gravity of the said rolls are compensated or, alternatively, the load can be brought to the said rolls using an outside force, such as a roll 51 outside the set of rolls, with which, for example, the lower roll 32 would be pressed towards the intermediate rolls 4 in the direction of the set of rolls. The direction of the plane of the set of rolls is the same as the direction of the plane drawn through the central line of the rolls in the set of rolls.

FIG. 2 also shows the nip load distribution achieved by the additional load F1 brought to the lower roll 3; 32. The nip load directed to a certain roll nip N is drawn to continue always over the entire roll for illustrating the loads, although the nip pressure influencing in a certain roll nip would not continue in a similar way in the roll itself. From the diagram in the Figure it can be seen that a bigger linear load can be achieved to the roll nips between the lower roll 32 and the fixedly attached intermediate roll 43, i.e. the roll nips Na2, Nb2, Nc2 by the additional load F1 than to the roll nips Na1, Nb1 and Nc1 located after the fixedly attached intermediate roll 4; 43, as the set of rolls 2 is observed from the influencing direction of the force (load) F1. Because the load coming from the first side of the fixedly attached intermediate roll 4; 43 decreases considerably when transferring from the roll nip on the first side of the said intermediate roll to the roll nip on the opposite side of this intermediate roll, it is possible to considerably influence the linear load distribution of the roll nips with the fixed intermediate roll and to then adjust the profiling of both sides of the fibre web in a more exact manner than before.

The multi-roll calender shown in FIG. 3A consists of two sets of rolls 2 attached to the same frame, with a so-called reverse nip between them. The sets of rolls are identical and for illustrating this, their parts are indicated by the same numbers. Both sets of rolls 2; 21 and 2; 22 consist of upper and lower rolls 31, 32 fixedly attached to the frame, and of three intermediate rolls 4, the middlemost 42 intermediate roll of which is fixedly attached to the frame. The outermost intermediate rolls 41 and 43 are polymer-coated elastic rolls, and the intermediate roll 42 attached to the frame is a heated smooth-surfaced chill roll. The outermost intermediate rolls are suspended to the frame from their bearing houses by loading arms in a similar way as is shown in FIG. 1 in connection of the intermediate rolls 41, 42, 44 and 45. The upper roll 31 and the lower roll 32 are heated smooth-surfaced chill rolls and they have internal loading devices for the rolls. The structure of the loading devices is similar to the one shown in FIG. 1, in which the structure of the upper and lower rolls is described. The path of the fibre web W in the roll nips is shown by arrows with closed ends; for simplifying the figure, the take-off rolls are not shown in the figure. The last roll 3; 32 of the first set of rolls 2; 21 and the first roll 3; 31 of the second set of rolls 2; 22 are smooth-surfaced chill rolls so that a so-called reverse nip is formed to the set of rolls in which case it is possible to control the profiling of both sides of the fibre web with the set of rolls.

The sets of rolls 2 of the multi-roll calender shown in FIG. 3B and the markings of their parts are similar to those in FIG. 3A, but the sets of rolls are now arranged to different frames so that the fibre web W is brought from one set to the other in air.

It is obvious for one skilled in the art that it is possible to realize the invention in many other ways in addition to the embodiments disclosed in the examples above.

Thus, even if one set of rolls in the multi-roll calender (multi-nip calender) according to the invention preferably has a relatively small number of rolls, in some cases there may be as many as 10-15 rolls in each set of rolls. In the sets of rolls described above, the uppermost and the lowermost roll are so-called sym rolls, in which pressure elements containing several different pressurizing zones are used for loading the casing of the roll. However, it is fully possible to replace the above-mentioned internal loading devices of the rolls with other loading devices known from the state of the art, with which the casing of the lower and/or upper roll can be moved to the direction of the intermediate rolls in a plane defined by the set of rolls.

Likewise, in the examples disclosed above, the sets of rolls are located substantially in an angle of 90 degrees in relation to the horizontal plane. However, the angle of the plane of the set of rolls in relation to the horizontal plane has no significance as such, and by placing a multi-roll calender or part of its rolls, for example, to the horizontal plane or to some other angle between 0 and 90 degrees, a part of the own gravity of the intermediate rolls or all of it can be left uncompensated. If the own gravity of the intermediate rolls need not be compensated, equipment for lightening the own weight of the intermediate rolls is not necessarily needed in these intermediate rolls, either.

In the examples disclosed above, the first and last roll in the set of rolls and the fixedly attached intermediate roll are attached to the (calender) frame. However, it is also entirely possible to attach the said rolls to other structures in a paper or cardboard machine or to a support located on the floor.

| Reference numbers of the main parts of the figures | |
|---|---|
| Calender | 1 |
| Set of rolls | 2 |
| First or last roll | 3 |
| Intermediate rolls | 4 |
| Lightening element | 5 |
| Take-off roll | 6 |
| Frame | 7 |
| Fibre web | W |
| Roll nip | Na, Nb, Nc |

In other parts, a numbering mode has been followed, in which the first number of the part informs to which main part the said part is connected.

The invention claimed is:

1. A multi-nip calender for calendering a fiber web, the calender comprising:

a first set of rolls attached to a first frame, the first set of rolls having a first roll, a last roll, and a first intermediate roll between the first roll and the last roll, a second intermediate roll between the first intermediate roll and the last roll, and a third intermediate roll between the second intermediate roll and the last roll;

wherein the first, the second, and the third intermediate rolls lack internal devices for loading or moving the rolls, and wherein the second intermediate roll being rotatable about an axis which is fixed with respect to the frame, and the first and third intermediate rolls are mounted for vertical motion on the frame;

wherein the first roll and the last roll are polymer-coated rolls each having a casing which is movable with respect to a portion fixed to the first frame, and each having internal loading devices with which the casing is movable toward the second intermediate roll; and a plurality of roll nips is defined between the rolls of the first set of rolls, such that the rolls from the first roll to the last roll alternate between polymer-coated rolls and metal rolls, and the roll nips in the set of rolls are closed by moving the casing of the first roll with its internal loading devices in a first direction parallel to a plane extending through the set of rolls toward the second intermediate roll, and the roll nips in the set of rolls are closed by moving the casing of the last roll with its internal loading devices in a second direction opposite the first direction and parallel to the plane extending through the set of rolls, towards the second intermediate roll.

2. The multi-nip calender of claim 1 further comprising at least one additional intermediate roll, said at least one additional intermediate roll lacking internal loading devices for loading or moving the rolls and having an axis which is movable with respect to the frame, said at least one additional intermediate roll being positioned between the second intermediate roll and the first roll or between the second intermediate roll and the last roll.

3. The multi-nip calender of claim 2, in which said at least one intermediate roll, and the first intermediate roll and third intermediate roll has equipment for lightening its weight.

4. The multi-nip calender of claim 2 in which a linear load distribution of the roll nips in the set of rolls is controlled by an additional load brought to the first and/or last roll in the set of rolls, wherein:

the additional load of the first roll in the set of rolls is used for influencing the linear load distribution of the roll nips between the second intermediate roll and the last roll to a substantially lesser extent than the linear load distribution of the roll nips between the second intermediate roll and the first roll; and the additional load of the last roll in the set of rolls is used for influencing the linear load distribution of the roll nips between the second intermediate roll and the first roll to a substantially lesser extent than the linear load distribution of the roll nips between the second intermediate roll and the last roll.

5. The multi-nip calender of claim 4 wherein the additional load is brought to the first and/or last roll in the set of rolls using a loading element outside said roll.

6. The multi-nip calender of claim 5 wherein the loading element is a roll.

7. The multi-nip calender of claim 4 wherein the additional load is brought to the first and/or last roll in the set of rolls using the internal loading devices of said first and/or last roll.

8. The multi-nip calender of claim 1, wherein the first roll and/or the last roll are shoe rolls, in which the internal loading devices of the first roll and/or the last roll comprise one or several shoe elements located under the casing of the roll, at the roll nip, which one or several shoe elements can be loaded with liquid so that the casing of the first roll and/or the last roll moves in relation to the second intermediate roll in the set of rolls.

9. The multi-nip calender of claim 8, wherein the first roll and/or the last roll has two or several shoe elements for moving the casing of the first roll and/or the last roll and for profiling the fiber web.

10. A multi-nip calender for calendering a fiber web, the calender comprising:

a frame;

a first roll which is a polymer-coated roll having a casing which is movable with respect to a portion fixed to the frame, and the first roll having an internal loading devices with which the casing is movable toward a first intermediate roll;

a last roll which is a polymer-coated roll having a casing which is movable with respect to a portion fixed to the frame, the last roll having internal loading devices with which the casing is movable toward the first intermediate roll, wherein the first intermediate roll is positioned between the first roll and the last roll;

a second intermediate roll having a casing and positioned on the frame between the first intermediate roll and the last roll;

a third intermediate roll positioned on the frame between the second intermediate roll and the last roll;

a fourth intermediate roll having a casing and positioned on the frame between the third intermediate roll and the last roll;

a fifth intermediate roll positioned on the frame between the fourth intermediate roll and the last roll;

wherein the first intermediate roll lacks an internal loading device for loading or moving the first intermediate roll;

wherein the second intermediate roll lacks internal loading devices for loading or moving the second intermediate roll;

wherein the third intermediate roll lacks internal loading devices for loading or moving the third intermediate roll;

wherein the fourth intermediate roll lacks internal loading devices for loading or moving the fourth intermediate roll;

wherein the fifth intermediate roll lacks internal loading devices for loading or moving the fifth intermediate roll; and wherein the third intermediate roll is rigidly mounted to the frame, and the first, second, fourth, and fifth intermediate rolls each have an axis which is movable with respect to the frame so that the first, second, fourth, and fifth intermediate rolls are mounted for vertical motion on the frame;

a plurality of roll nips defined between the first roll, first, second, third, fourth, and fifth intermediate rolls and the last roll, such that the rolls from the first roll to the last roll alternate between polymer-coated rolls and metal rolls, and that roll nips between the first roll and the third intermediate roll are closeable by moving the casing of the first roll with its internal loading devices in a first direction towards the third intermediate roll, and so that roll nips between the last roll and the third intermediate roll are closeable by moving the casing of the last roll with its internal loading devices in a second direction opposite the first direction towards the third intermediate roll.

11. The multi-nip calender of claim 10 in which a linear load distribution of the roll nips in the multi-nip calender is controlled by an additional load brought to the first and/or last roll in the set of rolls, wherein:

the additional load of the first roll in the set of rolls is used for influencing the liner load distribution of the roll nips between the third intermediate roll and the last roll to a substantially lesser extent than the linear load distribution of the roll nips between the third intermediate roll and the first roll; and the additional load of the last roll in the set of rolls is used for influencing the linear load distribution of the roll nips between the third intermediate roll and the first roll to a substantially lesser extent than the linear load distribution of the roll nips between the third intermediate roll and the last roll.

12. The multi-nip calender of claim 11 wherein the additional load is brought to the first and/or last roll in the set of rolls using a loading element outside said roll.

13. The multi-nip calender of claim 12 wherein the loading element is a roll.

14. The multi-nip calender of claim 11 wherein the additional load is brought to the first and/or last roll in the set of rolls using the internal loading devices of said first and/or last roll.

* * * * *